United States Patent [19]

Golda et al.

[11] 4,072,589

[45] Feb. 7, 1978

[54] PROCESS FOR ELECTROLYTIC GRAINING OF ALUMINUM SHEET

[75] Inventors: Eugene Golda, Monsey; Jen-chi Huang, Yonkers; Ken-ichi Shimazu, Pleasantville; Simon Long Chu, Dobbs Ferry, all of N.Y.

[73] Assignee: Polychrome Corporation, Yonkers, N.Y.

[21] Appl. No.: 787,192

[22] Filed: Apr. 13, 1977

[51] Int. Cl.[2] ..... C25F 3/04; C25F 5/00

[52] U.S. Cl. ..... 204/129.4; 204/129.75

[58] Field of Search ..... 204/129.4, 129.75

[56] References Cited

U.S. PATENT DOCUMENTS

| | | | |
|---|---|---|---|
| 3,887,447 | 6/1975 | Sheasby et al. | 204/129.4 |
| 3,980,539 | 9/1976 | Lloyd et al. | 204/129.75 |

FOREIGN PATENT DOCUMENTS

| | | | |
|---|---|---|---|
| 2,250,275 | 4/1974 | Germany | 204/129.4 |
| 134,093 | 6/1959 | U.S.S.R. | 204/129.75 |

*Primary Examiner*—John H. Mack
*Assistant Examiner*—D. R. Valentine

[57] ABSTRACT

A method for electrolytically graining the surface of aluminum sheets useful in the production of lithographic printing plates which comprises subjecting said aluminum sheets to the action of alternating electric current in an aqueous electrolytic solution containing, in combination, small but effective amounts of both hydrochloric and nitric acids.

6 Claims, No Drawings

PROCESS FOR ELECTROLYTIC GRAINING OF ALUMINUM SHEET

This invention relates to a method of graining the surface of aluminum sheets which are useful in the production of lithographic printing plates. More particularly, this invention relates to a method of imparting a very fine porous grain to the surface of aluminum sheets designed for use in the production of lithographic printing plates, which method comprises treating an aluminum sheet with alternating electrical current in an aqueous electrolytic solution containing as electrolytes a combination of small but effective amounts of hydrochloric acid and nitric acid.

In the manufacture of lithographic printing plates, it has been found most desirable to employ aluminum or aluminum alloy sheets as the base support therefore. In addition, it has been found that most satisfactory aluminum lithographic plates are obtained when the surface of the aluminum or aluminum alloy base support sheet is treated to impart thereto a grained or roughened and porous character. Heretofore, a number of methods have been employed to impart a grained surface to the aluminum base support sheet, including both mechanical and electro-chemical processes.

The mechanical graining method of treating aluminum sheets, for example, by wire brushing, results in a grained surface which is relatively rough and uneven, and in many lithographic printing application does not give satisfactory results. It is also known that the electrolytic graining of aluminum can provide a fine and uniform grain to the surface of the aluminum. Various methods of electrolytically graining aluminum sheets have been employed, for example, as taught by U.S. Pat. Nos. 3,072,546, 3,073,765, and 3,980,539, and French Pat. No. 2,110,257. In some of the prior art processes employed it has been found that unless the process if carefully controlled, the resultant grained surface obtained can be pitted, coarse and irregular, characteristics which are not desirable in lithographic printing plates.

We have now found a method for promptly and efficiently electrolytically graining the surface of aluminum sheets in such a manner as to yield aluminum sheets which have a very fine, porous and uniform grain surface which is most desirable for use in the production of lithographic printing plates. More particularly, the process of this invention comprises electrolytically graining aluminum in an aqueous electrolyte solution containing hydrochloric acid and nitric acid with an alternating electric current in such a manner that the amp. minutes per square foot of aluminum surface and treated is in excess of 150 with concentrations of hydrochloric acid and nitric acid sufficient that a fine, substantially porous and uniform grain that is substantially free from irregular pits is formed on the surface of the aluminum thus treated.

In the successful practice of the process of this invention, the aluminum which is contemplated to be employed is that aluminum or aluminum alloys which are designed and intended for employment in the production of lithographic printing plates. Thus, the aluminum to be employed herein are such aluminum sheets and webs which are specifically designed for use in the manufacture of lithographic printing plates, and includes such aluminum as is produced and sold by the Aluminum Company of America as lithographic grade Alloy No. 3003, or Alloy No. 1100, as generally known and understood in the industry.

The aluminum may then be electrolytically treated in accordance with the process of this invention. The electrolytic solution employed in the practice of this invention is an aqueous electrolytic solution which requires the presence, in combination, of a small but effective amount of hydrochloric acid and a small but effective amount of nitric acid, as the active electrolytes. More specifically, it has been found that most successful results are obtained when the aqueous electrolytic solution contains concentrated hydrochloric acid in combination with concentrated nitric acid. It has also been found that satisfactory results are obtained when the concentrated hydrochloric acid (defined as containing at least 32% HCl by weight) is present in the electrolytic solution in a concentration of from at least 0.1% to about 1.0% by weight, and most preferably, in a concentration of from 0.2% to 0.7% by weight. The nitric acid electrolyte should also be present in the aqueous electrolytic solution in a concentration of at least 0.4% to about 6.0% by weight and preferably, in a concentration of from 0.8% to 4.3% by weight. It has been found, in the most preferable practice of this invention, that most satisfactory results are obtained when 4 to 6 parts by weight of nitric acid are combined with 1 part by weight of hydrochloric acid.

The conditions under which the electrolytic treatment of the aluminum sheet in the electrolytic solution may be performed are those which will provide from 150 to 300 amp. minutes per square foot of the aluminum surface being treated in accordance herewith. Most preferable results may be obtained in the practice of this invention where the electrolytic treatment conditions provide from 180 to 220 amp. minutes per square foot of aluminum surface being treated hereunder.

It has most unexpectedly been found that the desired and advantageous results of this invention are not obtained when the critical conditions of its operations are outside the scope of those set forth above. For example, it has been found that when the ratio of nitric acid to hydrochloric acid is more than 6 or less than 4 to 1, the resultant surface of the aluminum sheet being treated is irregular non-porous and pitted, all characteristics the practice of this invention avoids.

It has also been found in the practice of this invention that the temperature at which the process is operated is apparently critical in achieving the desired results. The temperature at which the electrolytic graining process is conducted must be maintained at a high enough level to assure that a fine, uniform and substantially porous grain is obtained. It has been determined that satisfactory results are obtained when the temperature of operation is maintained at least at 40° C. and above, and preferably between 40° C. and 60° C. If the temperature at which the electrolytic graining is conducted is too low, for example, below 40° C. the grain obtained is undesirably rough and not usually employable in the production of lithographic printing plates.

The electrolytic graining process of this invention may be carried out in a batch, semi-continuous or continuous manner, employing the aluminum to be treated hereunder in the form of either sheets, foils or in continuous webs, as may be desired by the skilled worker. While the amount of time required for the completion of the process of this invention may vary, according to the conditions of operation under which it is practiced by the skilled worker, it has been found that satisfactory results can be obtained in a time period as little as thirty seconds. Most satisfactory results have been obtained when the process is practiced for from 60 to 90 seconds, although other periods of operation also provide satisfactory results.

The invention may be further illustrated by the following Examples.

EXAMPLE 1

A piece of aluminum foil 0.4 mm thick and measuring 4 inches square was immersed in a 5% w/w solution of NaOH for 30 seconds at room temperature to clean the surface thereof. The aluminum alloy was purchased as lithographic grade aluminum Alloy No. 3003 from the Aluminum Company of America. The thus treated aluminum was then washed and immersed in an electrolytic bath containing 0.4% by weight of concentrated hydrochloric acid and 2.0% by weight of concentrated nitric acid in deionized water. An alternating current at 16 volts and a current density of 232 amp. minutes per square foot was passed from the foil through the electrolyte to a counter electrode. The temperature of the electrolytic bath was maintained at about 42.5° C. during the process. Only one side of the aluminum foil sample was grained, the back thereof being effectively masked. The foil was then washed with water.

EXAMPLE 2

The procedure of Example 1 was followed except that the ratios of the hydrochloric and nitric acid electrolyte were varied. The resultant grained foil was obtained and the surface roughness of the two foil samples were analyzed in a Scanning Electron Microscope (Cambridge Instrument Co., Stereoscan-600 Model) with the following results:

TABLE I

| Electrolyte | Ratio HCl : $HNO_3$ | | Results* |
|---|---|---|---|
| A | 1:10 | (SEM 283) | Non-porous, irregular pitted surface |
| B | 1:3 | (SEM 287) | Pitted, irregular |
| C | 1:5 | (SEM 285) | Porous, consistent uniform surface |
| D | 1:1 | (SEM 289) | Non-porous, irregular surface |

*Scanning Electron Microscope Magnifaction = 2000 ×

From the foregoing, it can be seen that the surface obtained by the practice of this invention provides a uniform, porous and non-pitted surface whereas the other surfaces do not possess the desired characteristics.

In order to produce presentized lithographic printing plates from the aluminum sheets of this invention, the aluminum sheets are coated with a lithographically suitable photosensitive coating as taught and disclosed by U.S. Pat. Nos. 3,046,120, and 3,181,461 and other like disclosures known to the skilled worker. In addition, if it is desired to employ an interlayer to bond the photosensitive coating to the surface of the aluminum a sodium silicate interlayer as taught in U.S. Pat. No. 2,714,066, as is known to the skilled worker.

This invention may be variously otherwise embodied within the scope of the appended claims.

What is claimed is:

1. A method for electrolytically graining aluminum which comprises immersing the aluminum in an aqueous electrolytic solution containing in combination, one part by weight of hydrochloric acid and from four to six parts by weight of nitric acid as electrolytes, applying thereto an alternating electric current of from 150 to 300 amp. minutes per square foot and maintaining the electrolytic solution at a temperature of 40° C. or above.

2. The method of claim 1 wherein the nitric acid is present in a concentration of from 0.8% to 6.0% by weight.

3. The method of claim 1 wherein the hydrochloric acid is present in a concentration of from 0.2% to 1.0% by weight.

4. The method of claim 1 wherein the hydrochloric acid is present in a concentration of from 0.2% to 0.7% by weight; the nitric acid is present in a concentration of from 0.8% to 4.3% by weight; and the current is from 180 to 220 amp. minutes per square foot.

5. The method of claim 1, wherein the temperature of the electrolytic solution is maintained at a temperature of from 40° C. to 60° C.

6. The method of claim 1, wherein 1 part by weight of hydrochloric acid is combined with 5 parts by weight of nitric acid.

* * * * *